US010062219B2

(12) United States Patent
Richter et al.

(10) Patent No.: US 10,062,219 B2
(45) Date of Patent: Aug. 28, 2018

(54) METHOD FOR DETERMINING THE CAUSE OF FAILURE IN A VEHICLE

(71) Applicant: VOLKSWAGEN AG, Wolfsburg (DE)

(72) Inventors: Felix Richter, Hannover (DE); Tetiana Aymelek, Bietigheim-Bissingen (DE); Andreas Sasse, Braunschweig (DE)

(73) Assignee: VOLKSWAGEN AG (DE)

( * ) Notice: Subject to any disclaimer, the term of this patent is extended or adjusted under 35 U.S.C. 154(b) by 4 days.

(21) Appl. No.: 15/224,994

(22) Filed: Aug. 1, 2016

(65) Prior Publication Data

US 2017/0039785 A1 Feb. 9, 2017

(30) Foreign Application Priority Data

Aug. 3, 2015 (DE) ..... 10 2015 214 739

(51) Int. Cl.
*G07C 5/08* (2006.01)
*G07C 5/00* (2006.01)

(52) U.S. Cl.
CPC ..... *G07C 5/0808* (2013.01); *G07C 5/008* (2013.01)

(58) Field of Classification Search
CPC ..... G07C 5/0808; G07C 5/008
USPC ..... 701/29.6
See application file for complete search history.

(56) References Cited

U.S. PATENT DOCUMENTS

| | | | | |
|---|---|---|---|---|
| 8,560,165 | B2 * | 10/2013 | Salman | G05B 23/0283 701/31.5 |
| 2008/0004764 | A1 * | 1/2008 | Chinnadurai | G05B 23/0235 701/31.4 |
| 2008/0177438 | A1 | 7/2008 | Chen et al. | |
| 2012/0041637 | A1 | 2/2012 | Allemang | |
| 2013/0198737 | A1 | 8/2013 | Ricci | |
| 2014/0277902 | A1 | 9/2014 | Koch | |
| 2014/0324275 | A1 * | 10/2014 | Stanek | G07C 5/0816 701/31.4 |
| 2015/0269793 | A1 * | 9/2015 | Collins | G07C 5/0808 701/31.4 |
| 2015/0309859 | A1 * | 10/2015 | Elzein | H04L 41/0873 714/49 |

FOREIGN PATENT DOCUMENTS

| | | | |
|---|---|---|---|
| DE | 10235525 | A1 | 4/2003 |
| DE | 102011076037 | A1 | 5/2012 |
| DE | 102014105674 | A1 | 10/2014 |
| EP | 2731085 | A1 | 5/2014 |

* cited by examiner

*Primary Examiner* — Brian P Sweeney
(74) *Attorney, Agent, or Firm* — Barnes & Thornburg LLP

(57) ABSTRACT

A method for determining a cause of fault in a vehicle. The method involves a fault report being received on a server outside the vehicle and a cause of fault being determined in the server based on the fault report and load collective data from the vehicle and/or based on the fault report and vehicle condition variables from the vehicle.

19 Claims, 8 Drawing Sheets

METHOD FOR DETERMINING THE CAUSE OF FAILURE IN A VEHICLE

PRIORITY CLAIM

This patent application claims priority to German Patent Application No. 10 2015 214 739.8, filed 3 Aug. 2015, the disclosure of which is incorporated herein by reference in its entirety.

SUMMARY

Illustrative embodiments relate to a method for determining a cause of fault in a vehicle, particularly to a method in which the cause of fault in the vehicle is determined automatically using online services in a server outside the vehicle. Illustrative embodiments further relate to a vehicle that supports such online-based cause of fault determination in a server, and to a server that is suitable for performing the method.

BRIEF DESCRIPTION OF THE DRAWINGS

Disclosed embodiments will be described in detail below with reference to the drawings.

DETAILED DESCRIPTION

Figure 1:
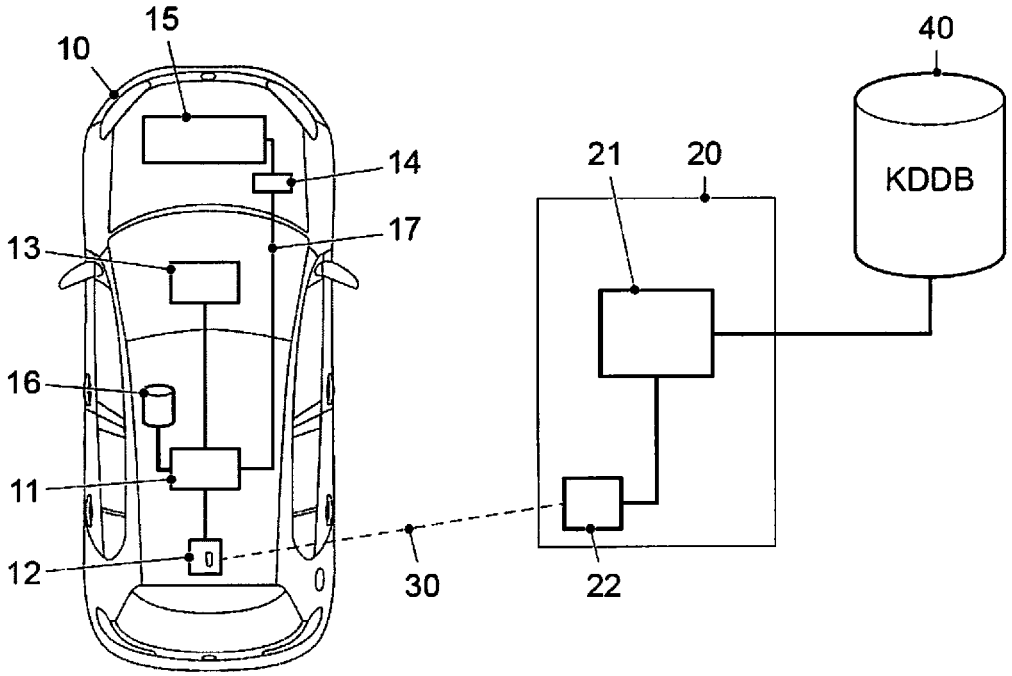
FIG. 1 shows a vehicle and a server according to a disclosed embodiment.

In a vehicle, for example, an automobile or a truck, fault reports from controllers and sensors can be reported using what is known as an onboard diagnosis function, for example. When such a fault report arises in the vehicle, however, the actual cause is frequently not known. When an increased coolant temperature is reported as a fault, for example, the causes of the fault may be many and diverse, for example, a lack of cooling liquid on account of a leak in the cooling system, an inadequate liquid flow rate on account of vapor bubbles or a faulty coolant pump, or overheating on account of a previous vehicle load and climatic conditions. An example of one possibility for ascertaining the cause of fault is a call to a call center, where what are known as fault trees are stored, which are processed using questions. This may be intensive in terms of personnel and time, however.

In this connection, DE 10 2014 105674 discloses a system having a vehicle controller that has a processor and communicates with a communication device and a vehicle display. The controller is configured to receive a sensor input that contains a fault trigger and/or context-dependent data captured during the fault trigger. The controller can analyze the fault trigger using the processor to determine a fault event. The controller can determine a suitable workshop and transmit the fault event and the context-dependent data to the workshop via the communication device. The controller may be configured to receive an analysis report and an appointment enquiry and to output the analysis report and the appointment enquiry to a vehicle display device.

EP 2 731 085 relates to a telecommunication terminal and a method for supporting the maintenance or repair of vehicles. A vehicle has a diagnosis interface and the vehicle has an associated vehicle identification information item that is optically detectable. The diagnosis interface has a wireless interface and the telecommunication terminal has a further wireless interface and is configured so as to process an information item relating to the vehicle condition and retrievable via the diagnosis interface. The mobile telecommunication terminal has a camera device. The diagnosis interface, the wireless interface and the further wireless interface are configured to transmit the at least one information item relating to the vehicle condition to the telecommunication terminal. The camera device of the telecommunication terminal is configured to capture the vehicle identification information item. The information item relating to the vehicle condition, on the one hand, and the vehicle identification information item, on the other hand, can be used to define at least one measure for maintenance or repair of the vehicle.

US 2014/0277902 relates to what is known as crowd sourcing of vehicle-related analyses, for example, mass querying of vehicle-related analyses. Vehicles typically have a computer that outputs diagnostic fault codes (Diagnostic Trouble Codes, DTC) that indicate fault conditions in a vehicle. Diagnosis fault codes (DTCs) indicate a specific problem with a specific component, such as that a cylinder in an engine has a misfire, for example, but provide no evidence of the reason for the problem and propose no solutions for solving the problem. Therefore, systems are disclosed that analyze DTCs and other telemetric data using crowd sourcing principles to recommend vehicle maintenance and other solutions.

DE 10 2011 076 037 relates to a system for providing a vehicle diagnosis service that comprises a diagnosis unit and a control unit. The diagnosis unit is set up to analyze a cumulatively stored diagnostic fault code (Diagnostic Trouble Code, DTC) to analyze a problem history for a particular vehicle. The control unit compares a DTC received from a telematics apparatus of a vehicle with the problem history to determine whether or not there is a problem in the vehicle, informs a driver about problem information if it is determined that the vehicle has a problem, generates a control signal for setting a diagnosis period for an item connected to the problem and transmits the control signal to the telematics apparatus of the vehicle.

DE 102 35 525 discloses a condition monitoring system that captures and archives aggregate data from many vehicles during the life of the vehicle. This past history can consist of the vehicle identification number, timestamps, load collectives, histograms, data profiles over time or knowledge derived from onboard diagnosis functions and data analysis functions. Additionally, the condition monitoring captures diagnosis and maintenance data from telematics service centers, workshops (diagnosis data, repairs, maintenance condition) and technical test departments. Standards for "normal vehicle behavior" and "problematic vehicle behavior" are derived by processing the combined data using machine learning and data mining methods. For example, speed, engine speed, engine temperature, engine torque, ambient temperature, fuel consumption and emission values are analyzed to identify normal and abnormal behavior. These standards are used to adapt and personalize onboard system diagnosis algorithms, and they allow analysis outside the vehicle for many and diverse applications, such as the prediction of imminent vehicle problems and determination of the vehicle maintenance status, for example.

On account of the rising complexity of vehicle engineering, there is therefore a great need for fast and reliable cause of fault determination when an error arises on a vehicle.

Disclosed embodiments provide a method for determining a cause of fault in a vehicle, a vehicle, and a server.

A disclosed method for determining a cause of fault in a vehicle involves a server outside the vehicle receiving a fault report from the vehicle. The fault report is generated in the vehicle on the basis of a fault condition of the vehicle. By way of example, the fault report can comprise a diagnostic fault code, what is known as a diagnostic trouble code (DTC), which is generated by a controller of the vehicle using sensors of the vehicle. A diagnostic fault code of this kind can be provided by a vehicle diagnosis system, what is known as onboard diagnosis (OBD), for example, duration operation of the vehicle. In the server, the received fault report and load collective data from the vehicle are taken as a basis for determining a cause of fault. Alternatively or additionally, the cause of fault is determined in the server on the basis of the fault report and vehicle condition variables from the vehicle.

The load collective data, which are also called load collectives, relate to the sum total of all loads that have arisen over a period on a component or an assembly of the vehicle. By way of example, a load collective for an internal combustion engine of the vehicle can indicate over what periods the internal combustion engine has been operated at what speed or over what periods what torque has been output by the engine. Load collectives can be recorded for different assemblies of the vehicle during operation of the vehicle, for example, for the internal combustion engine, for a gearbox, for a suspension system, a brake system, an air conditioning installation or a power-assisted steering system. The load collective data therefore indicate a summary of loads for a component in the past and are therefore also referred to as data for the vehicle history. The load collective data are determined particularly prior to generation of the fault report in the vehicle and are transmitted from the vehicle to the server.

The vehicle condition variables from the vehicle relate to current variables and measured values that are captured by sensors of the vehicle, for example. By way of example, the vehicle condition variables can comprise a coolant temperature, an engine temperature, a vehicle speed, an engine speed, an engine torque, a selected gear in a gearbox of the vehicle, etc. The server transmits requests to the vehicle to ascertain particular vehicle condition variables and to transmit the vehicle condition variables to the server. Following ascertainment of the desired vehicle condition variables in the vehicle, the vehicle condition variables can be transmitted from the vehicle to the server autonomously, for example, or can be retrieved by the server.

The involvement of load collective data, i.e., past loads on the vehicle, what is known as a vehicle history, in the determination of the cause of fault following an occurrence of a fault report allows the cause of fault to be ascertained with greater reliability. By virtue of the load collective data being transmitted from the vehicle to the server automatically, it is possible for the cause analysis to be performed promptly in the server automatically, so that the cause of fault can be ascertained and assessed quickly. By virtue of additional vehicle condition variables from the vehicle being requested by the server as required and taken into account for determining the cause of fault, the cause of fault can be determined automatically in the server with great accuracy and quickly. Further, only a minimum of necessary data is transmitted.

According to at least one disclosed embodiment, the method further involves a cause of fault being determined on the basis of customer service data. The customer service data can comprise information about the vehicle itself that has been ascertained and recorded during a past workshop visit, such as repairs performed, parts replaced and also complaints or observations by the customer, for example. The customer service data can further comprise information about other vehicles that has been ascertained and recorded during workshop visits by these other vehicles. Customer service data from vehicles of identical design or similar design or vehicles having a similar year of construction can be taken into account. The customer service data can further comprise causes of fault for given fault reports, load collective data and/or vehicle condition variables. The customer service data are retrieved by the server from a customer service database on the basis of the fault report. This assists fast and precise ascertainment of the cause of fault. Further, a repair standard can be automatically generated from the customer service data on the basis of the determined cause of fault. By way of example, the repair standard comprises a list of required spare parts for rectifying the cause of fault and the work items required for substituting the spare parts. Further, the repair standard can comprise an estimate of the costs for the repair. On the basis of the repair standard, a workshop can schedule a repair to the vehicle in good time, for example.

In a further disclosed embodiment, the aforementioned operations for determining the cause of fault in a vehicle are performed in the following order. First, a cause of fault is determined on the basis of the customer service data that are retrieved from the customer service database on the basis of the fault report. A cause of fault is then determined on the basis of the fault report and load collective data from the vehicle. Finally, a cause of fault is determined on the basis of the fault report and vehicle condition variables from the vehicle. After each of these operations for determining the cause of fault, a respective current quality value for the respective cause of fault can be determined. By way of example, the quality value indicates how high the likelihood is that the determined cause of fault is the actual cause of fault, and hence the vehicle can be repaired again completely or at least adequately by rectifying the determined cause of fault. Determination of the cause of fault in the order described above is performed on the basis of the quality value of the previously performed cause of fault determination. If a very high Q factor of the cause of fault has already been determined for the cause of fault on the basis of customer service data, for example, then the operations for determining the cause of fault on the basis of the fault report and the load collective data and also the determination of the cause of fault on the basis of the fault report and the vehicle condition variables can be omitted. If the quality value of a cause of fault on the basis of the customer service data is not sufficiently high, however, then the cause of fault is determined on the basis of the fault report and the load collective data. Should the quality value for the determined cause of fault not be sufficiently high in this case either, then the cause of fault is determined on the basis of the fault report and the vehicle condition variables. This sequential approach can minimize the communication between the vehicle and the server, what is known as a back end. Whether or not the current quality value for the respective cause of fault is already adequate can be ascertained automatically by means of a decision-maker, for example, by comparing the quality value with a prescribed threshold value. The thus most recently determined cause of fault, i.e., the cause of fault that has a quality value that is sufficiently high, is transmitted from the server to the vehicle to be output in the vehicle, for example, to a driver of the vehicle. By way of example, the cause of fault can be output to the driver via a screen of the vehicle and can comprise additional information, such as a severity of the fault, for example, which reveals whether continued travel is possible or whether the vehicle needs to be taken to a workshop as soon as possible or even is best towed to the workshop to prevent further damage to the vehicle, for example. Further, at least some information from the repair standard can be output to the driver, so that the driver is provided with an overview of costs and amount of time for the repair.

In a further disclosed embodiment, the aforementioned operations for determining the cause of fault, i.e., determination of a cause of fault on the basis of customer service data, determination of a cause of fault on the basis of the fault report and load collective data from the vehicle and determination of a cause of fault on the basis of the fault report and vehicle condition variables from the vehicle, are performed at parallel times and a resultant cause of fault is determined on the basis of the causes of fault determined in the respective operations. If multiple different causes of fault have been determined in individual operations, the resultant cause of fault can be determined using a majority decision or by weighting the causes of fault, for example. By virtue of all of the previously described operations for determining a cause of fault being performed at least to some extent at parallel times, the resultant cause of fault can be determined with great reliability and accuracy. The execution at parallel times means that the resultant cause of fault can be ascertained in a short time.

In a further disclosed embodiment, the fault report comprises a diagnosis fault code and a vehicle identification designation. The diagnosis fault code is associated with the fault condition and, by way of example, contains an index number for identifying malfunctions that can arise during operation of a vehicle. The diagnosis fault code is also referred to as a diagnostic trouble code (DTC). By way of example, the vehicle identification designation indicates a vehicle type of the vehicle and, furthermore, possibly equipment features of the vehicle. By way of example, the vehicle identification designation can comprise a vehicle-individual number, for example, a vehicle identification number (VIN), that can be used to univocally identify a vehicle. The vehicle identification designation can be used to ascertain information pertaining to the vehicle or pertaining to similar vehicles from the customer service database in a simple manner.

In a further disclosed embodiment, the determination of a cause of fault on the basis of the fault report and load collective data from the vehicle includes the load collective data from the vehicle being compared with load collective data from another vehicle in which the same fault condition has arisen. If a cause of fault has been ascertained for this fault condition in the other vehicle, then there is a high likelihood of there also being an identical or similar cause of fault in the vehicle from which the fault report has been received. Since loads on the vehicle in the past can have a critical influence on a cause of fault, consideration of the load collective data from other vehicles for corresponding fault reports means that there is a high likelihood of it being possible to assume that there is the same cause of fault, which means that the cause of fault can be determined with great reliability.

The fault reports, the load collective data and the vehicle condition variables can be transmitted via a radio link between the vehicle and the server. Use of a radio link allows determination of the cause of fault to be performed in the server while the vehicle is actually traveling, so that a cause of fault can be determined in good time and, as a result, breakdown of the vehicle or consequential faults in the vehicle can be avoided, for example.

In a further disclosed embodiment, the determination of the cause of fault on the basis of the fault report and the vehicle condition variables involves a test plan being generated on the basis of the fault report. The test plan is designed such that the condition variables from the vehicle can be taken as a basis for iteratively determining a cause of fault from a prescribed set of causes of fault. The required vehicle condition variables are requested on the basis of the test plan. The test plan can be processed automatically, for example, in the server. The server can request the vehicle condition variables from the vehicle successively on the basis of the test plan. This allows the communication effort between the server and the vehicle to be minimized.

According to the disclosed embodiments, a vehicle is provided that comprises a processing apparatus and a transmission apparatus for transmitting data between the vehicle and a server outside the vehicle. The processing apparatus is capable of generating a fault report on the basis of a fault condition of the vehicle and of transmitting the fault report to the server. By way of example, the fault report can comprise a diagnosis fault code (diagnostic trouble code, DTC) that is provided by a control apparatus of the vehicle using what is known as an onboard diagnosis, for example. The processing apparatus is further capable of determining load collective data, particularly prior to generation of the fault report in the vehicle, and of transmitting the load collective data from the vehicle to the server. By way of example, the load collective data can be determined and collected continuously in the vehicle. Alternatively or additionally, the processing apparatus is further capable of ascertaining vehicle condition variables on the basis of requests from the server to the vehicle in the vehicle and of transmitting the vehicle condition variables from the vehicle to the server. As a result, the vehicle is capable of performing the previously described method or one of the disclosed embodiments thereof in conjunction with a server. This allows a cause of a fault in the vehicle to be determined reliably and quickly.

The vehicle may further comprise an output unit that is coupled to the processing apparatus. The processing apparatus can receive a cause of fault determined by the server from the server by means of the transmission apparatus and output the cause of fault to a vehicle user via the output unit. As a result, the vehicle user can be informed about a possible cause of fault within a very short time after an occurrence of a fault in the vehicle.

According to the disclosed embodiments, a server is provided that comprises a processing apparatus and a transmission apparatus for transmitting data between the server and a vehicle. The processing apparatus is capable of receiving a fault report from the vehicle via the transmission apparatus. The fault report has been generated in the vehicle on the basis of a fault condition of the vehicle. The processing apparatus is further capable of determining a cause of fault on the basis of the fault report and load collective data from the vehicle. The load collective data are determined prior to generation of the fault report in the vehicle and are transmitted from the vehicle to the server, for example, on the basis of a request from the server. Alternatively or additionally, the processing unit can determine the cause of fault on the basis of the fault report and vehicle condition variables from the vehicle. To this end, the server requests the vehicle condition variables from the vehicle. In the vehicle, the requested vehicle condition variables are ascertained and are transmitted as a response to the server. The server is therefore suitable for performing the previously described method or one of the disclosed embodiments thereof and therefore also comprises the previously described benefits.

Although the features of the method, the vehicle and the server that have been described above have been described in different embodiments, these disclosed embodiments can be combined with one another arbitrarily.

FIG. 1 shows a vehicle 10, a server 20 and a customer service database KDDB 40. The vehicle 10 is connected to the server 20 via a radio link 30. By way of example, the radio link 30 can be provided by means of a telecommunication network, for example, GSM or LTE. The vehicle 10 comprises a processing apparatus 11, for example, a microprocessor or a controller, a transmission apparatus 12 and an output unit 13. By way of example, the transmission apparatus 12 may comprise a transmission and reception apparatus that is capable of setting up the radio link 30 to the server 20 to transmit data between the vehicle 10 and the server 20. By way of example, the output unit 13 may comprise a display in a dashboard of the vehicle 10, particularly a screen, for example, a screen of a navigation system or of an entertainment system of the vehicle 10. The processing apparatus 11 is coupled to the transmission apparatus 12 and the output unit 13. The processing apparatus 11 is further connected via a vehicle bus 17, for example, to controllers of the vehicle 10, for example, to an engine controller 14 that controls a drive engine 15 of the vehicle 10. The vehicle bus 17 may couple the processing apparatus 11 to further control apparatuses and sensors of the vehicle 10 to obtain particularly diagnosis information from the vehicle 10, what is known as onboard diagnosis information. The processing apparatus 11 is further coupled to a memory apparatus 16 in which data can be collected that the processing apparatus 11 collects during operation of the vehicle 10. By way of example, the data stored in the memory apparatus 16 may comprise what are known as load collective data, which comprise use and load profiles of the vehicle 10. By way of example, the load collective data can indicate over what periods the drive engine 15 of the vehicle 10 has been operated at what speeds or torques.

The server 20 comprises a processing apparatus 21 and a transmission apparatus 22. The transmission apparatus 22 is suitable for transmitting data between the vehicle 10 and the server 20. The server 20 is coupled to the customer service database 40, in which customer service information is stored that has been captured during a workshop visit by the vehicle 10 or by other vehicles. By way of example, the customer service data may comprise information concerning what parts have been replaced on the vehicle 10 at what time and what faults have been rectified on the vehicle 10 at what time. By way of example, the customer service database 40 may store that a particular cause of fault has been ascertained in a vehicle 10 on the basis of an occurrence of a particular fault report, and then particular parts of the vehicle 10 have been replaced.

The manner of operation of the vehicle 10 in conjunction with the server 20 and the customer service database 40 will be described in detail below on the basis of different examples with reference to FIGS. 2 to 8.

Determination of a cause of fault for a fault in the vehicle 10 is performed outside the vehicle 10 in the server 20. This is made possible by the increasing networking of vehicles, for example, via the radio link 30. Further, information from the vehicle 10 itself that has been collected prior to the occurrence of the fault, information from the customer service database 40 and current information from the vehicle 10 that has been captured by sensors, for example, are taken into account. In connection with FIG. 2, a sequential or iterative process is proposed in this regard. In summary, this process comprises the operations of analysis of customer service data, analysis of the load collective data, which are also referred to as vehicle history, and a guided online fault search. In this case, the order of the process operations is geared to the volume of data that need to be transmitted between the vehicle 10 and the server 20. If a process operation cannot identify a univocal cause of fault, the next process operation starts and further data that are necessary therefor are requested from the vehicle 10.

First, the vehicle 10 sends a fault report, for example, a diagnosis fault code (diagnostic trouble code, DTC), together with a vehicle identification designation (vehicle identification number, VIN) to the server 20. The fault report has been generated in the vehicle 10 on the basis of a fault condition of the vehicle 10. By way of example, the fault report can be generated by the engine controller 14 and can be transmitted to the server 20 via the processing apparatus 11 and the transmission apparatus 12.

In the server 20, an analysis of customer service data for this fault report takes place in a first operation at 201. To this end, customer service data are requested from the customer service database 40 and the customer service data are sent from the customer service database 40 to the server 20. If it has been possible to find a cause of fault on the basis of the analysis of the customer service data, then this cause of fault is transmitted to the vehicle 10 in operation at 204 and displayed on the output unit 13, for example. If it has not been possible to find a cause on the basis of the analysis of the customer service data or if it has not been possible to establish the cause with sufficient certainty, which is determined by means of a decision-maker in the server 20, for example, then an analysis of the vehicle history is performed in the server 20 in operation at 202 for the received fault report. To this end, the server 20 requests the vehicle history from the vehicle 10. The vehicle history, what is known as load collective data, which have been collected in the vehicle 10 in the data memory 16, is then sent from the processing apparatus 11 to the server 20 via the transmission apparatus 12. On the basis of the vehicle history, a cause for the reported fault is sought in the server 20. If a cause of fault has been determined sufficiently accurately, which is stipulated by an appropriation decision-maker, for example, then the cause of fault is transmitted to the vehicle 10 in operation at 204, where it is output on the display unit 13, for example. If it has not been possible to determine a suitable cause for the fault report on the basis of the vehicle history in operation at 202 either, then a guided fault search is initiated online in the server 20 in operation at 203. By way of example, the guided fault search can be performed on the basis of a test plan that is selected or generated on the basis of the fault report in the server 20. The test plan allows current condition variables from the vehicle 10 to be taken as a basis for iteratively determining a cause of fault from a prescribed set of causes of fault. To this end, different measured variables are requested from the vehicle 10, these being determined in the vehicle 10 and sent from the vehicle 10 to the server 20. This requesting and sending of measured variables can be performed repeatedly in succession for different operations of the test plan. A decision-maker can in turn establish whether the cause of fault determined using the guided fault search has a sufficient quality or Q factor to be output to the vehicle user or customer in operation at 204. If a cause of fault has again not been determined univocally or with an adequate Q factor, then the method is continued in operation at 205, in which an appropriate output to the driver is used to output the recommendation to call a call center or to arrange a workshop appointment, for example.

Figure 3:
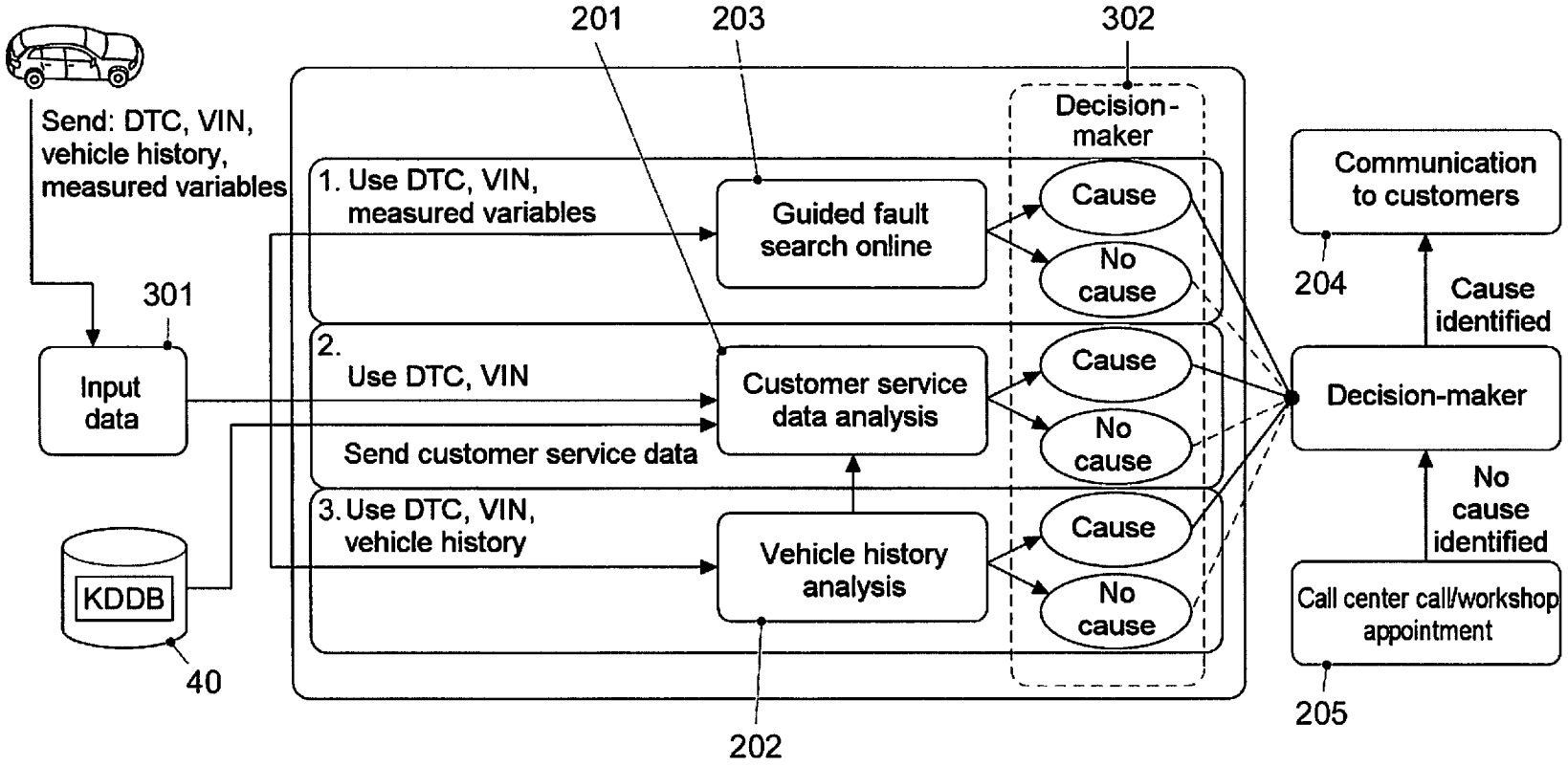
FIG. 3 schematically shows a method for determining a cause of fault in a vehicle according to a further disclosed embodiment.

FIG. 3 shows an alternative example of the determination of a cause of fault on the basis of customer service data, vehicle history and guided fault search. In the example shown in FIG. 3, the three process operations at 201 to 203 are not performed successively on the basis of one another, but rather are performed in parallel. To this end, the data from the vehicle 10 are collected completely as input data 301 and processed in the server 20. In the server 20, the guided fault search, the analysis of the customer service data and the analysis of the vehicle history are executed in parallel and, possibly, relevant causes of fault are ascertained from each of these operations at 201 to 203. By way of example, a decision-maker 302 can use a weighting of the ascertained causes of fault to determine an overall cause of fault that is transmitted to the vehicle 10 in operation at 204 for output to the vehicle user or customer. If the decision maker 302 has not been able to find a univocal cause of fault, then a recommendation to the vehicle user to call a call center or to arrange a workshop appointment is output in operation at 205.

Figure 2:
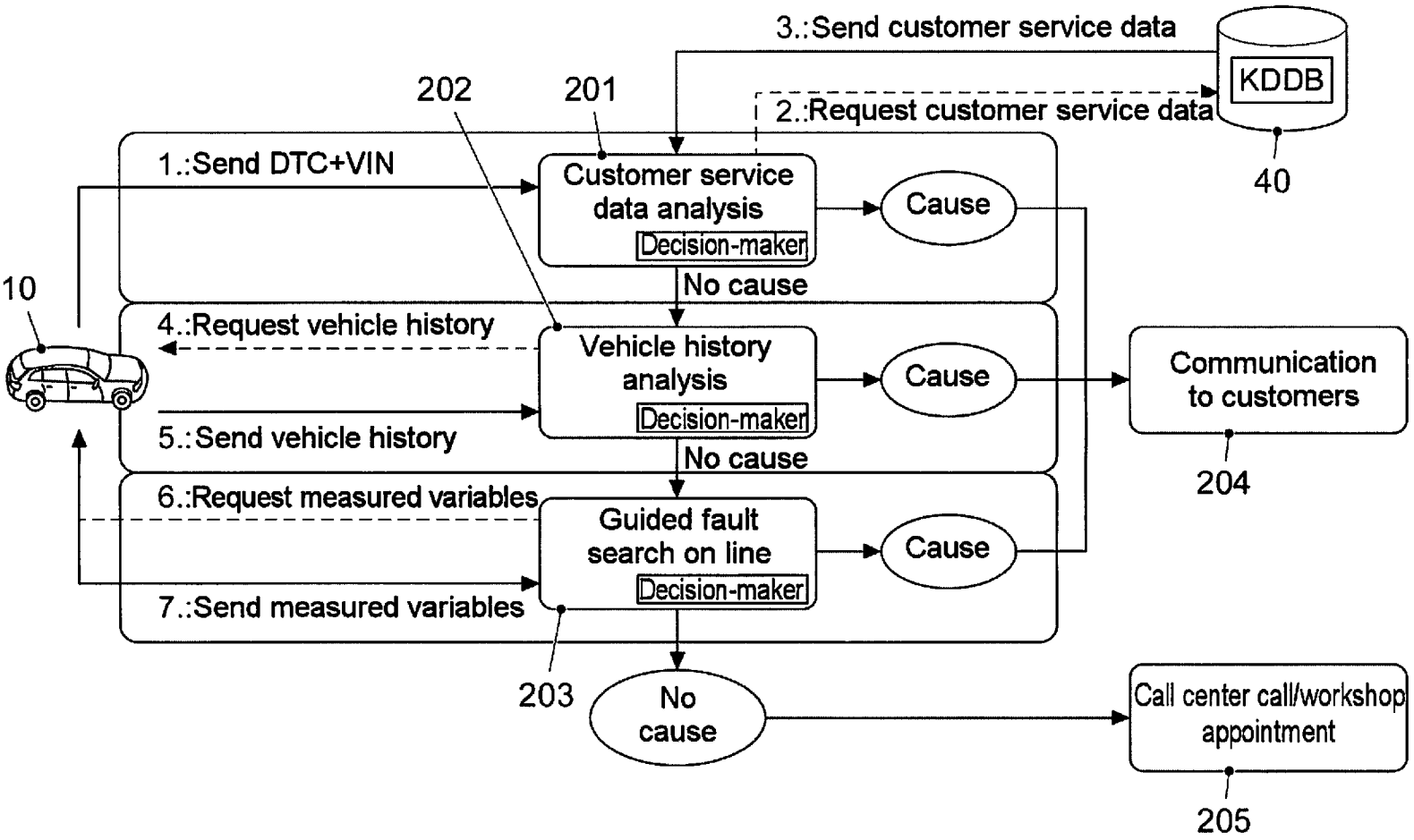
FIG. 2 schematically shows a method for determining a cause of fault in a vehicle according to a disclosed embodiment.
Figure 4:
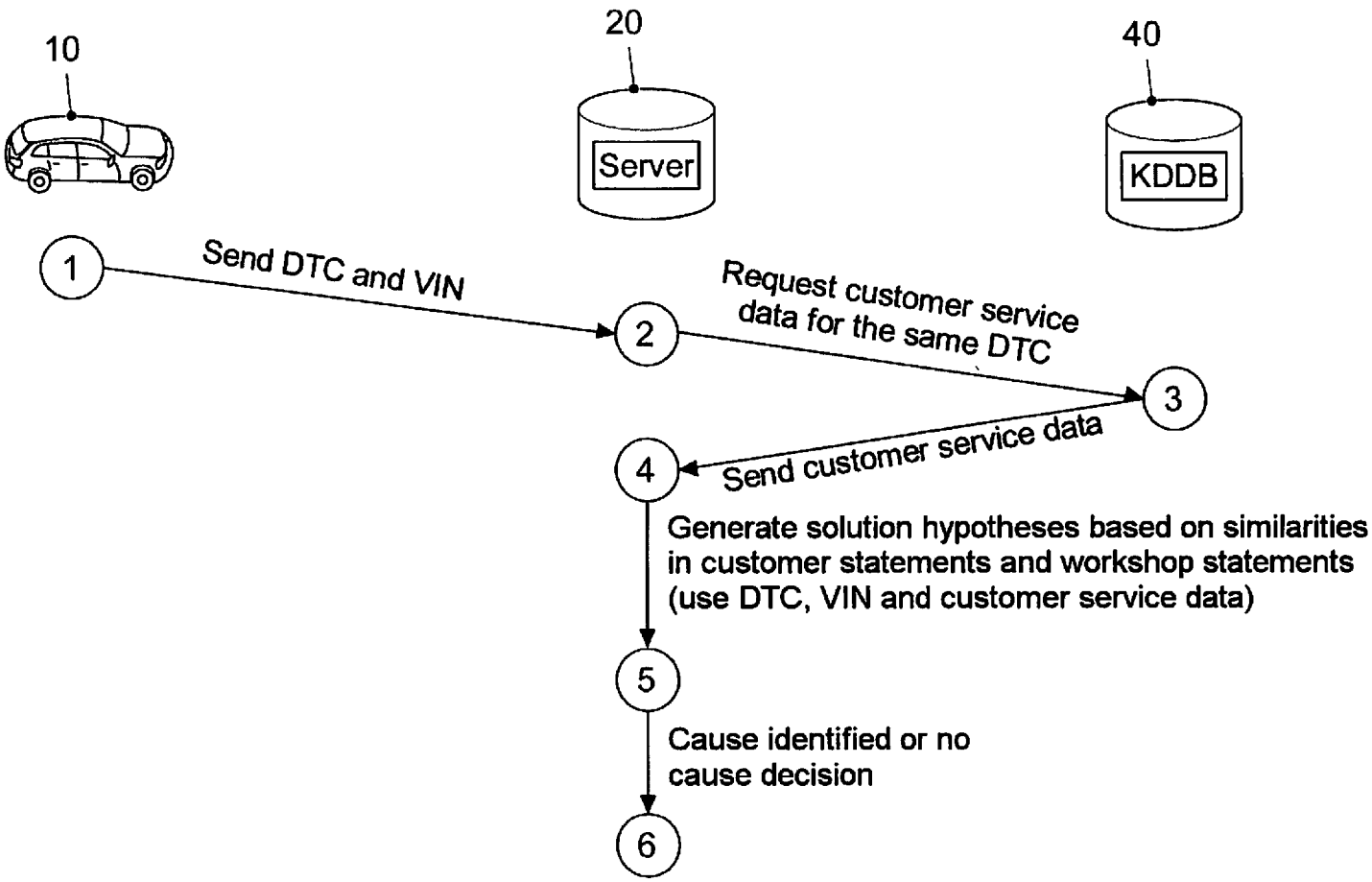
FIG. 4 shows details of a method operation for determining a cause of fault on the basis of customer service data.
Figure 5:
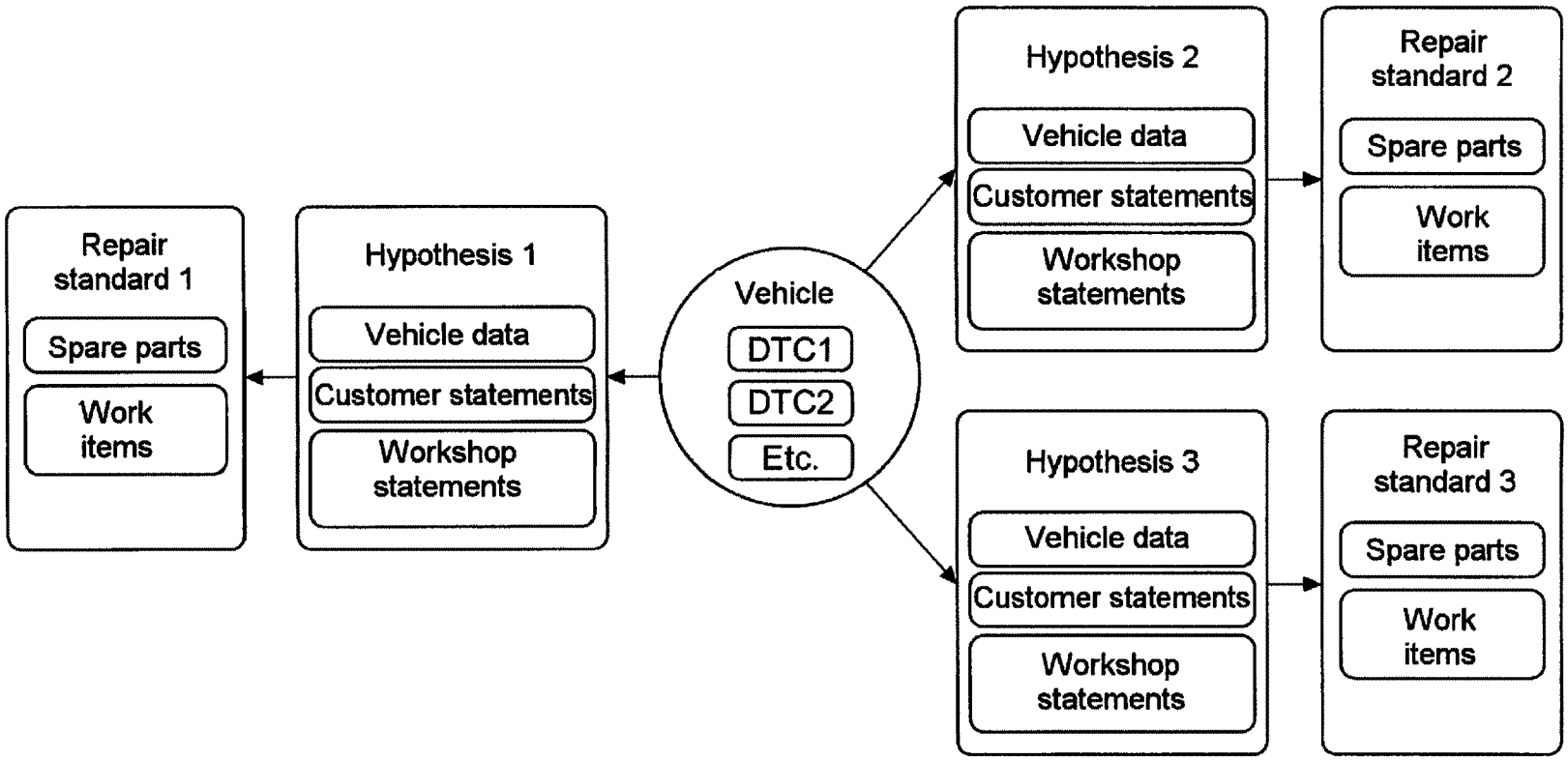
FIG. 5 shows details of a method operation for generating repair standards from customer service data.

FIG. 4 shows details of the determination of a cause of fault taking account of an analysis of customer service data, as can be used in operation at 201 in FIGS. 2 and 3, for example. The vehicle 10 sends a fault report to the server 20, which fault report comprises, by way of example, a diagnosis fault code or fault memory entry (DTC) and a vehicle identification designation, for example, a vehicle identification number (VIN). This transmission of the vehicle identification number and of the fault memory entry starts an online analysis in the server 20 for the purpose of identifying possible solutions to the fault situation by means of an analysis of the customer service data. To this end, the server 20 requests customer service data for one and the same DTC from the customer service database 40. The customer service database 40 sends the customer service data to the server 20, and the server 20 generates solution hypotheses based on similarities in customer statements and workshop statements using the DTC, VIN and further customer service data. By way of example, similarities between the current fault situation and fault cases that have already arisen can be identified within the customer service data to generate solution hypotheses for the current fault situation on this basis. The Q factor of the solution hypothesis, i.e., the Q factor of the determined cause of fault, is then rated and a decision is made as to whether the cause of fault has actually been identified or whether the cause of fault has not been identified. The hypothesis formation for different fault reports (DTC1, DTC2, etc.) is shown in detail in FIG. 5. Each hypothesis has associated corresponding vehicle data, such as vehicle type, vehicle equipment, age of the vehicle, etc., for example, customer statements that describe fault conditions and workshop statements, such as what components may potentially be faulty and therefore require replacement, for example. As the result of each hypothesis, what are known as repair standards can be produced, which contain the spare parts and work items that are required for repairing the cause of fault. On the basis of the repair standard, a workshop can produce an estimate of cost, for example, or schedule the time for a repair to the vehicle. The repair standards can, provided that one of the hypotheses is deemed a probable cause of fault, be transmitted to the vehicle and used therein by the vehicle user when arranging a workshop appointment.

Figure 6:
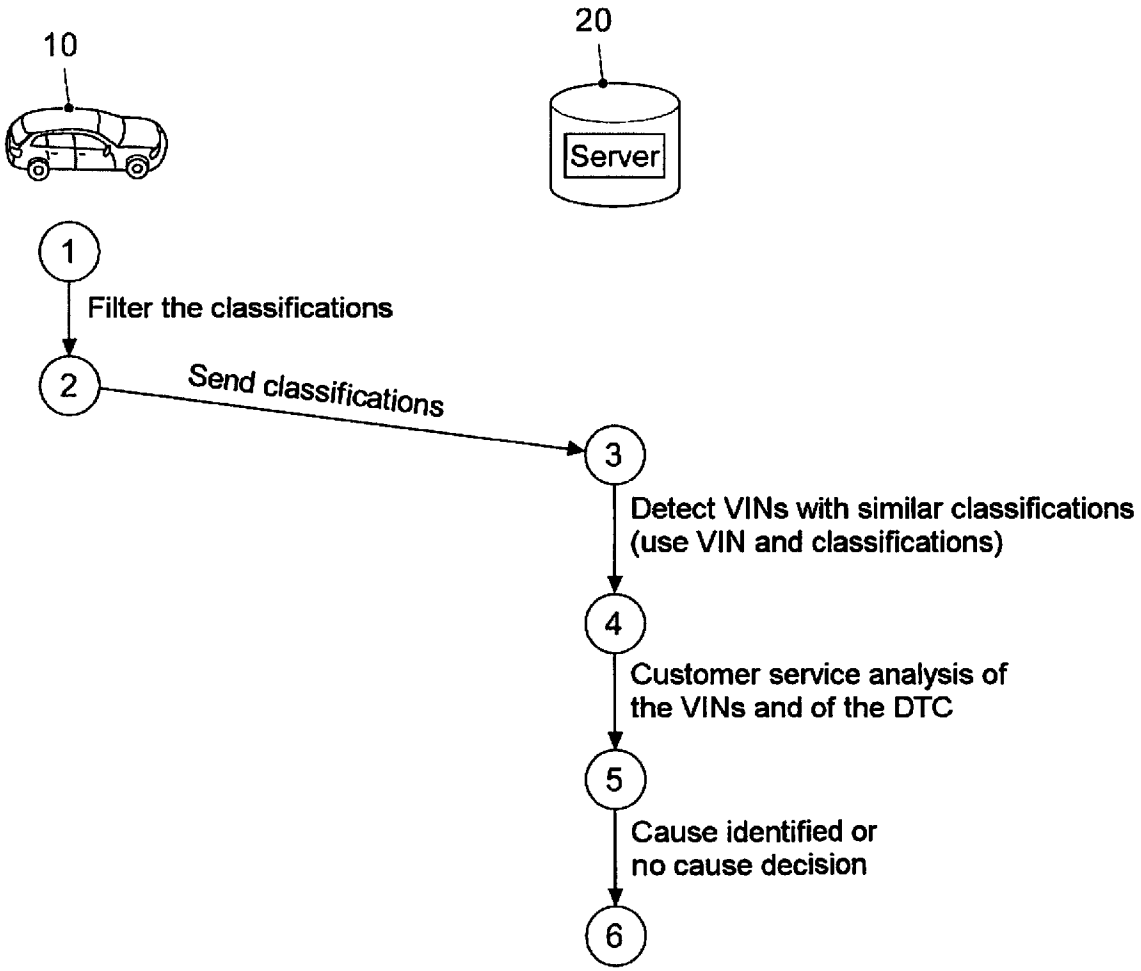
FIG. 6 shows details of a method operation for determining a cause of fault on the basis of load collective data from the vehicle.

FIG. 6 shows the analysis of the vehicle history from operation at 202 in FIGS. 2 and 3 in detail. In the vehicle 10, load conditions, such as engine speeds, engine torques, brake values, switching states and the like, for example, can be collected and can be stored as load collectives in the memory apparatus 16. In other words, particular feature values of the vehicle are categorized into groups or classes during operation of the vehicle. Such categorization of feature values is also referred to as classification. With regard to the engine speed, it is possible, by way of example, for the classification or load collective stored in the memory apparatus 16 to be over what period the drive engine 15 of the vehicle 10 has been operated in a speed range of between 1000 and 1500 revolutions, over what period the drive engine 15 has been operated in a speed range of between 1500 and 2000 revolutions per minute, etc. For the analysis of the vehicle history, it is possible to filter out classifications that are relevant to the current fault report (DTC), for example. The classifications are transmitted from the vehicle 10 to the server 20. Transmission of vehicle identification number and the historic vehicle behavior (classifications) allows the server 20 to identify vehicles that have had a similar vehicle behavior prior to a corresponding fault situation. A prerequisite for this is that corresponding classifications and fault situations for other vehicles are present in the server. Similarities between the classifications of the vehicle 10 and classifications of other vehicles that are stored in the server 20 are detected on a reduced set of classifications. On the basis of the resultant list of similar vehicles, it is possible for the customer service data to be searched while further taking account of the vehicle identification number and the diagnosis fault code (DTC), for example, as has been described previously with reference to FIG. 4. Finally, a decision is made as to whether or not a cause of fault has been identified.

Figure 7:
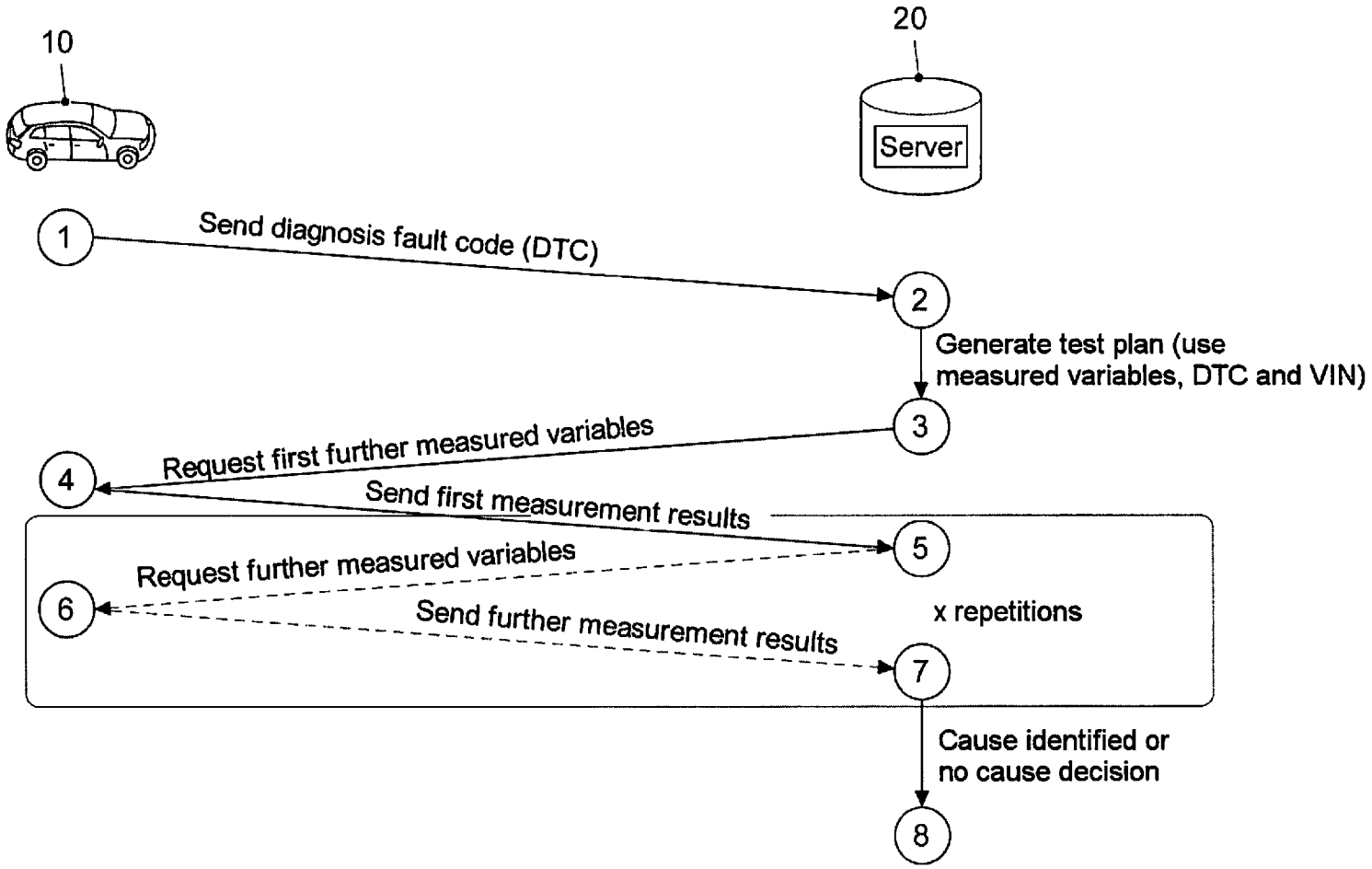
FIG. 7 shows details of a method operation for determining a cause of fault on the basis of vehicle condition variables.

FIG. 7 shows details of the guided fault search online from operation at 203. On the basis of the diagnosis fault code (DTC) received from the vehicle 10, the server 20 generates a test plan that uses measured variables from the vehicle. By way of example, the measured variables from the vehicle can comprise current sensor values from the vehicle, such as, by way of example, a current speed of the engine 15, a coolant temperature, an ambient temperature, an ambient air pressure, a boost pressure from an exhaust turbocharger of the drive engine 15, etc. The generated test plan is processed sequentially, for example, in the server, with further measured variables needing to be taken into account. These measured variables are requested from the vehicle 10, and the vehicle 10 ascertains these measured variables and returns them to the server 20. This can be repeated multiple times, so that the server 20 requests a multiplicity of measured variables from the vehicle 10 successively and the measured variables are transmitted from the vehicle 10 to the server 20. At the end of the test plan, a possible cause of fault can be determined or it is possible to determine that this test plan has not been able to be used to determine a cause of fault and therefore the vehicle needs to be examined more closely in a workshop.

Figure 8:
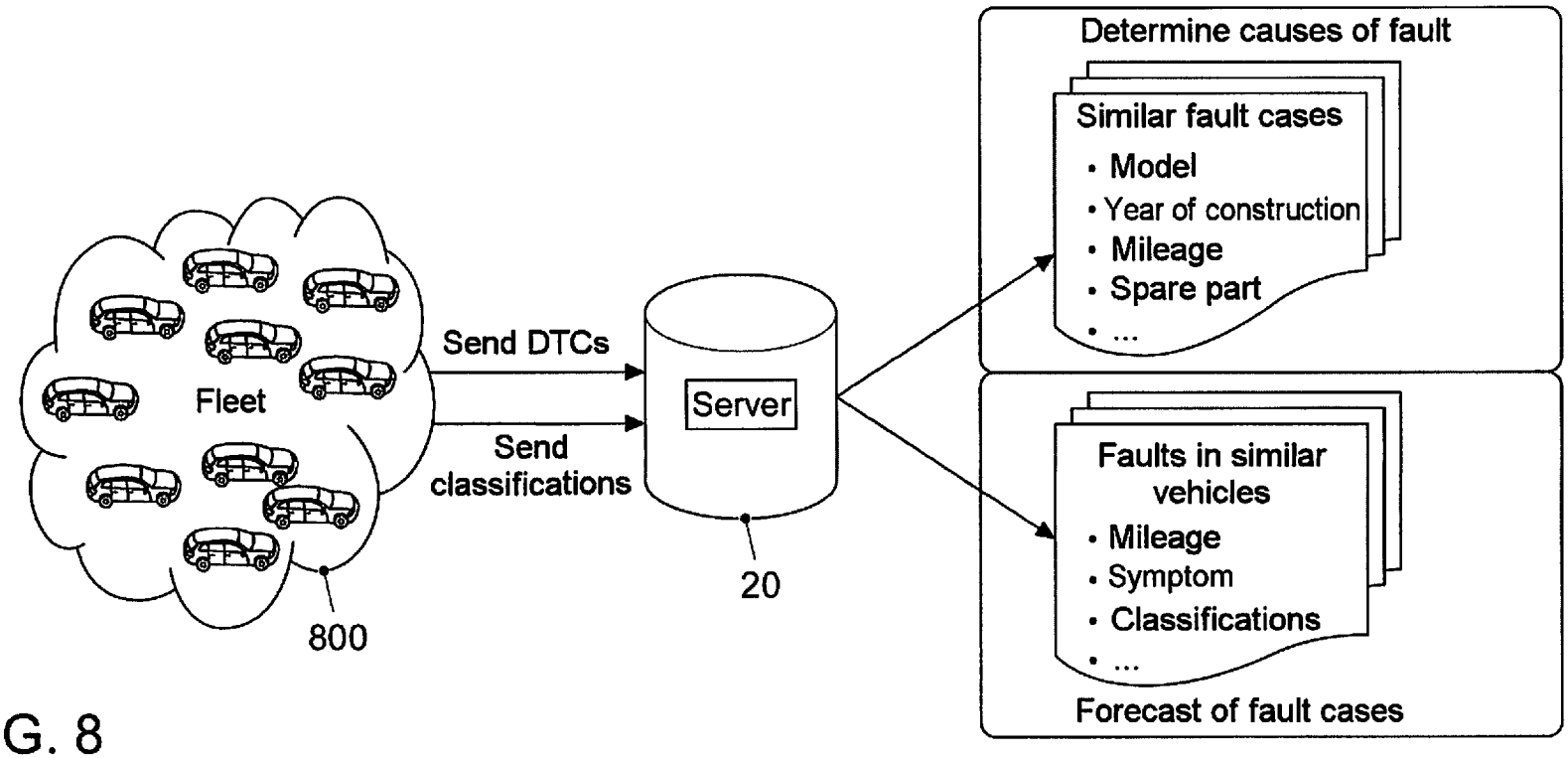
FIG. 8 schematically shows a method for determining a cause of fault in a vehicle and for forecasting fault cases in vehicles according to disclosed embodiments.

The method described above in which fault memory entries (DTC) and classifications are transmitted from vehicles to a server can be used particularly effectively if this information is collected by and available from a multiplicity of vehicles. FIG. 8 schematically shows a server 20 that collects fault memory entries and classifications from a vehicle fleet 800. This information can be used to determine causes of fault, as has been described above with reference to FIGS. 2 to 7, or to compile a forecast of fault cases in vehicles. The forecast can involve a query regarding the fault likelihoods of a vehicle being sent to the server. The database can be used to compare the historical context of the specific vehicle with the database, to determine fault cases for vehicles having a similar behavior. Faults in similar vehicles can be determined by taking account of the mileage of the vehicle, symptoms of the vehicle that have been described by the customers and classifications, for example.

The method for determining causes of fault that has been described above allows an increased identification rate for causes of fault and also online identification of causes of fault, so that the processing complexity in the vehicle can be minimized. Further, a minimal volume of data can be transmitted by virtue of the determination of the cause of fault being performed sequentially or iteratively, as has been described with reference to FIG. 2, for example. The results of the cause of fault determination can be used for anticipatory control of workshops, as has been described with reference to FIG. 5 on the basis of the repair standard, for example. Further, the forecast of fault cases can avoid faults by virtue of appropriate precautions being taken during maintenance or faults being able to be repaired online by means of configuration changes.

LIST OF REFERENCE SYMBOLS

10 Vehicle
11 Processing apparatus
12 Transmission apparatus
13 Output unit
14 Engine controller
15 Drive engine
16 Memory apparatus
17 Vehicle bus
20 Server
21 Processing apparatus
22 Transmission apparatus
30 Radio link
40 Customer service database
201 Customer service data analysis
202 Vehicle history analysis
203 Guided fault search online
204 Communication to customers
205 Call center call/workshop appointment
301 Input data
302 Decision-maker
800 Vehicle fleet

The invention claimed is:

1. A method for remotely determining a fault cause in a transportation vehicle, the method comprising:

receiving a fault report at a server located remotely from the transportation vehicle, wherein the fault report is generated in the vehicle based on a fault condition of the transportation vehicle, wherein the method comprises at least one of the following operations:

determining a fault cause in the server based on the fault report and at least one of load collective data from the vehicle, wherein the load collective data are determined prior to generation of the fault report in the vehicle and wherein the load collective data are transmitted from the vehicle to the server, and determining a fault cause in the server based on the fault report and vehicle condition variables from the vehicle, wherein the vehicle condition variables are ascertained based on requests from the server to the vehicle in the vehicle and are transmitted from the vehicle to the server, determining a corresponding current quality value for a determined fault clause;

analyzing the determined current quality value to determine whether to perform another fault clause determination based on the fault report and information other than that used to generate the fault cause corresponding to the determined current quality value;

determining a cause of fault based on customer service data that are retrieved by the server from a customer service database based on the fault report; and automatically generating a repair standard based on the determined fault cause based on the customer service data.

2. The method of claim 1, wherein the operations for determining fault causes are performed in the following order:

determining the fault cause based on customer service data;

determining the fault cause based on the fault report and load collective data from the vehicle; and determining the fault cause based on the fault report and vehicle condition variables from the vehicle.

3. The method of claim 2, wherein each of the operations for determining the fault cause is followed by determination of a corresponding current quality value for the respective fault cause, and the subsequent determination of the fault cause is performed based on the current quality value.

4. The method of claim 3, wherein a most recently determined quality value is used as a basis for transmitting a most recently determined fault cause from the server to the vehicle for output in the vehicle.

5. The method of claim 1, wherein the operations of determining the fault based on customer service data, determining the fault cause based on the fault report and load collective data from the vehicle, and determining the fault cause based on the fault report and vehicle condition variables from the vehicle are performed at parallel times and a resultant cause of fault is determined based on the determined fault causes.

6. The method of claim 1, wherein the fault report comprises a diagnosis fault code indicating the fault condition, and a vehicle identification designation indicating at least a vehicle type of the transportation vehicle.

7. The method of claim 1, wherein the operation of determining the fault cause based on the fault report and load collective data comprises comparison of the load collective data with load collective data from another vehicle in which the same fault condition has arisen.

8. The method of claim 1, wherein the fault report, the load collective data and/or the vehicle condition variables are transmitted via a radio link between the vehicle and the server.

9. The method of claim 1, wherein determining the fault cause based on the fault report and the vehicle condition variables comprises:

generating a test plan based on the fault report, wherein the fault cause is iteratively determined from a prescribed set of fault causes based on the test plan using the condition variables from the vehicle, and requesting vehicle condition variables based on the test plan.

10. A transportation vehicle comprising:

a processing apparatus; and a transmission apparatus for transmitting data between the transportation vehicle and a server the transportation vehicle, wherein the processing apparatus generates a fault report based on a fault condition of the transportation vehicle and transmits the fault report to the server, wherein the processing apparatus:

transmits load collective data from the vehicle to the server, wherein the load collective data have been determined prior to generation of the fault report in the vehicle, and/or ascertains vehicle condition variables based on requests from the server to the vehicle in the vehicle and transmits the vehicle condition variables from the vehicle to the server, wherein, based on information transmitted from the vehicle, determination of a corresponding current quality value for a determined fault clause is performed and analyzed to determine whether to perform another fault clause determination based on the fault report and information other than that used to generate the fault cause corresponding to the determined current quality value, wherein the transportation vehicle further comprises an output unit, wherein the processing apparatus receives a fault cause, determined by the server, from the server via the transmission apparatus and outputs the fault cause via the output unit, wherein the server automatically generates a repair standard from the fault cause that was determined based on the customer service data, and wherein the server automatically generates a repair standard from the fault cause that was determined based on the customer service data.

11. A server comprising:

a processing apparatus; and a transmission apparatus for transmitting data between the server and a remotely located transportation vehicle, wherein the processing apparatus receives a fault report, which has been generated in the transportation vehicle based on a fault condition of the transportation vehicle, via the transmission apparatus, wherein the processing apparatus carries out at least one of the following operations:

determining a fault cause based on the fault report and load collective data from the transportation vehicle, wherein the load collective data are transmitted from the transportation vehicle to the server, wherein the load collective data are determined prior to generation of the fault report in the transportation vehicle; and determining a fault cause based on the fault report and vehicle condition variables from the transportation vehicle, wherein the vehicle condition variables are ascertained based on requests from the server to the transportation vehicle, in the vehicle, and are transmitted from the transportation vehicle to the server, wherein the processing apparatus further determines a corresponding current quality value for a determined fault clause, and analyzes the determined current quality value to determine whether to perform another fault clause determination based on the fault report and information other than that used to generate the fault cause corresponding to the determined current quality value, wherein the server automatically generates a repair standard from the fault cause that was determined based on the customer service data, and wherein the server automatically generates a repair standard from the fault cause that was determined based on the customer service data.

12. The server of claim 11, wherein the operations for determining fault causes are performed in the following order:

determining the fault cause based on customer service data;

determining the fault cause based on the fault report and load collective data from the vehicle; and determining the fault cause based on the fault report and vehicle condition variables from the vehicle.

13. The server of claim 12, wherein each of the operations for determining fault causes are followed by a determination of a corresponding current quality value for the respective fault cause, and the subsequent determination of fault cause is performed based on the current quality value.

14. The server of claim 13, wherein a most recently determined quality value is used as a basis for transmitting the most recently determined fault cause from the server to the vehicle for output in the vehicle.

15. The server of claim 11, wherein the operations of determining the fault cause based on customer service data, determining the fault cause based on the fault report and load collective data from the vehicle, and determining the fault cause based on the fault report and vehicle condition variables from the vehicle are performed at parallel times and a resultant fault cause is determined based on the determined fault causes.

16. The server of claim 11, wherein the fault report comprises a diagnosis fault code indicating the fault condition, and a vehicle identification designation indicating at least a vehicle type of the transportation vehicle.

17. The server of claim 11, wherein the operation of determining the fault cause based on the fault report and load collective data comprises a comparison of the load collective data with load collective data from another vehicle in which the same fault condition has arisen.

18. The server of claim 11, wherein the fault report, the load collective data and/or the vehicle condition variables are transmitted via a radio link between the vehicle and the server.

19. The server of claim 11, wherein the determination of the fault based on the fault report and the vehicle condition variables comprises:

generating a test plan based on the fault report, wherein the fault cause is iteratively determined from a prescribed set of fault causes based on the test plan using the condition variables from the vehicle, and requesting vehicle condition variables based on the test plan.

* * * * *